US009267732B2

(12) United States Patent
Kim

(10) Patent No.: US 9,267,732 B2
(45) Date of Patent: Feb. 23, 2016

(54) REFRIGERATOR

(75) Inventor: Sung Kyoung Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 304 days.

(21) Appl. No.: 13/508,324

(22) PCT Filed: Nov. 8, 2010

(86) PCT No.: PCT/KR2010/007842

§ 371 (c)(1),
(2), (4) Date: May 4, 2012

(87) PCT Pub. No.: WO2011/056031

PCT Pub. Date: May 12, 2011

(65) Prior Publication Data

US 2012/0216560 A1 Aug. 30, 2012

(30) Foreign Application Priority Data

Nov. 6, 2009 (KR) ..... 10-2009-0106755
Nov. 9, 2009 (KR) ..... 10-2009-0107569
Jan. 20, 2010 (KR) ..... 10-2010-0005182

(51) Int. Cl.
*F25D 23/12* (2006.01)
*F25C 5/00* (2006.01)

(52) U.S. Cl.
CPC ..... *F25D 23/126* (2013.01); *F25C 5/005* (2013.01)

(58) Field of Classification Search
CPC ..... F25D 23/126; F25C 5/005
USPC ..... 62/347.389
See application file for complete search history.

(56) References Cited

U.S. PATENT DOCUMENTS 3,907,268 A * 9/1975 Hale ..... 269/21
4,597,270 A * 7/1986 Kerr ..... F25C 1/225 439/623
4,768,933 A * 9/1988 Stachowiak ..... F04B 53/1025 137/543.13
4,815,941 A * 3/1989 Fayo ..... 417/44.2
5,163,300 A 11/1992 Kato et al.
5,511,388 A * 4/1996 Taylor et al. ..... 62/389
5,737,932 A * 4/1998 Lee ..... 62/135
5,787,724 A * 8/1998 Pohl et al. ..... 62/389
2004/0025527 A1 2/2004 Takahashi et al.
2004/0187939 A1* 9/2004 Phillips ..... F16K 1/40 137/625.65
2005/0210909 A1 9/2005 Kim et al.
2005/0229623 A1* 10/2005 Kim ..... 62/389
2006/0090427 A1 5/2006 Hau et al.
2006/0097610 A1 5/2006 Lee et al.
2006/0230779 A1* 10/2006 Kwon ..... 62/398

(Continued)

FOREIGN PATENT DOCUMENTS

JP 2001248961 A * 9/2001
KR 10-2005-0098135 A 10/2005

(Continued)

*Primary Examiner* — Allana Lewin Bidder
*Assistant Examiner* — Kun Kai Ma
(74) *Attorney, Agent, or Firm* — Birch, Stewart, Kolasch & Birch, LLP

(57) ABSTRACT

Embodiments relates to a refrigerator that makes it possible to improve water supply performance by disposing an air exhaust unit in a water supply channel connected to the output side of a pump supplying water from a water tank to an ice maker or a dispenser, and effectively return water remaining when the use of dispenser is finished, by using an opening/closing member in the water supply channel, and a water tank for a refrigerator.

7 Claims, 14 Drawing Sheets

(56) References Cited

U.S. PATENT DOCUMENTS

| | | | | |
|---|---|---|---|---|
| 2007/0175919 | A1* | 8/2007 | Hortin et al. | 222/64 |
| 2008/0116226 | A1* | 5/2008 | Py et al. | 222/207 |
| 2008/0121667 | A1* | 5/2008 | Park et al. | 222/477 |
| 2009/0173089 | A1* | 7/2009 | LeClear et al. | 62/136 |
| 2009/0194193 | A1* | 8/2009 | Vonderhaar et al. | 141/65 |
| 2010/0229592 | A1* | 9/2010 | Lim | F25D 23/126 62/389 |
| 2010/0257875 | A1* | 10/2010 | Kim | F25D 23/126 62/74 |

FOREIGN PATENT DOCUMENTS

| | | | |
|---|---|---|---|
| KR | 10-2006-0040293 | A | 5/2006 |
| KR | 10-2006-0124942 | A | 12/2006 |

* cited by examiner

REFRIGERATOR

TECHNICAL FIELD

Embodiments relate to a refrigerator and a water tank for a refrigerator.

BACKGROUND ART

In general, refrigerators are appliances that can keep food at low temperature in a storage space which is closed by doors. In detail, the refrigerators keep food fresh by producing cold air by means of heat transfer with a coolant at low temperature and low pressure through a refrigeration cycle and maintaining the storage space at low temperature by using the cold air.

Those refrigerators gradually increase in size and are provided with various functions with changes and increase in dietary life while refrigerators equipped with various structures and convenience devices have been put on the market.

Typical ones of the convenient devices are an ice maker that makes ices and a dispenser, which are provided in the refrigerators. The ice maker and the dispenser are for providing users with ices or drinking water and may be disposed in the compartments or the doors.

In general, the ice makes are manufactured in a type of directly filling an ice-making tray with water or a type of filling a water tank having capacity for one-time ice-making with water and mounting the water tank such that the water is supplied from the water tank to the ice-making tray.

The structures, however, can make only one-time ices, and when a large-capacity water tank is used, the water is frozen in the water tank due to properties about temperature of the freezing compartment and continuous ice-making becomes impossible.

Refrigerators that are provided with a water supply line directed connected with the waterworks to continuously operate the ice maker and a dispenser also connected with the water supply line to take out drinking water from the dispenser have been come up with in order to remove the problems.

Further, refrigerators having a structure that is equipped with a water tank where water for making ice is supplied in the compartments and supplying water to the ice maker and the dispenser by using a pump and a water supply channel have been developed.

In the refrigerators having the structure, air may be mixed and supplied through the water supply channel, when water is completely supplied from the water tank without remaining or with a small amount of water remaining in the water tank, or in an abnormal state.

As air is mixed and supplied, the amount of ices made by the ice maker and is not uniform and the water splashes when being taken out of the dispenser, thereby causing problems in supplying water. Further, if air is mixed in the pump when the pump is operated again after supplying water, large load is exerted in the pump.

Further, since the water remaining in the pipe of the dispenser drops down after the water is taken out of the dispenser by operation of the dispenser in the refrigerators of the related art, which makes users sensitively dissatisfied.

DISCLOSURE OF INVENTION

Technical Problem

Embodiments provide a refrigerator that prevents air from being mixed with water supplied from a water tank to an ice maker and/or a dispenser and the water tank for the refrigerator.

Embodiments provide a refrigerator that makes it possible to effectively returning the remaining water when a dispenser is finished being used.

Solution to Problem

An embodiment of the present invention provides a refrigerator which includes: a water tank that is detachably provided in the refrigerator and stores water to supply to an ice maker or a dispenser; a water supply channel that is connected to supply the water in the water tank to the ice maker and the dispenser; a pump that is disposed in the water supply channel to pump up the water in the water tank; and an air exhaust unit that is disposed in the water channel connected with an output side of the pump and discharges air in the water tank to the outside.

Another embodiment of the present invention provides a refrigerator which includes: a water tank provided on a cold compartment door; an ice maker or a dispenser provided on a freezing compartment door; a water supply channel connecting the water tank with the ice maker and the dispenser and supplies water from the water tank; a pump disposed in the water supply channel and pumping up the water from the water tank to the ice maker or the dispenser; and an air exhaust unit disposed in the water supply channel connecting the pump with the ice maker or the dispenser and discharging air in the water supply channel to the outside.

Another embodiment of the present invention provides a refrigerator which includes: a water tank disposed in a cold compartment; an ice maker disposed in a freezing compartment; a water supply channel connecting the water tank with the ice maker and supplies water from the water tank; a pump disposed in the water supply channel and pumping up the water in the water tank to the ice maker; and an air exhaust unit disposed in the water supply channel connecting the pump with the ice maker and discharging air in the water supply channel to the outside, in which the air exhaust unit opens/closes an air exhaust portion from which air is discharged to the outside by buoyancy.

Another embodiment of the present invention provides a refrigerator which includes: a water tank disposed in the refrigerator and stores water to supply; a tank connector mounted on the water tank and attaching/detaching the water tank to/from one side in the refrigerator; a water supply channel connecting the water tank with an ice maker or a dispenser; an intake channel forming a portion of the water supply channel and extending into the water tank; inlets formed through one side of the intake channel and allowing water to flow inside from the water tank; and a floater moving up/down along the intake channel and selectively closing the inlets in accordance with a water level in the water tank.

Another embodiment of the present invention provide a water tank for a refrigerator which includes: a body disposed in the refrigerator and storing water to supply to an ice maker or a dispenser; an intake channel inserted in the body and moving up the stored water; an intake unit disposed at the end of the intake channel and having inlets guiding the water in the body to flow into the intake channel; and a floater fitted on the intake unit to move up/down along the intake unit and selectively closing the inlets while moving in accordance with a water level.

Another embodiment of the present invention provides a refrigerator which includes: a cabinet having a storage space; a door opening/closing the storage space; a dispenser disposed on the door to take out water; a water tank disposed in the storage space of the door and storing water to supply to the dispenser; a water supply channel movably connecting the water tank with the dispenser; a pump disposed in the water supply channel and supplying water to the dispenser while operating in a normal direction; and an opening/closing member disposed in the water supply channel in the water tank and reducing load in the pump by opening when the pump operates in the reverse direction.

Advantageous Effects of Invention

The refrigerator according to an embodiment of the present invention can discharge air from the water supply channel, because the air exhaust unit is disposed in the water supply channel between the output side of the pump and the ice maker or the dispenser.

Further, it is possible to discharge air from the air exhaust unit and supply only water to the ice maker and the dispenser, when air flows inside with water due to low water level or complete use of water in the water tank.

Therefore, it is possible to expect to improve water supply performance, because it can be expected to remove water supply defects in the ice maker and the dispenser.

Further, since the air passing through the pump is completely discharged and the pump is filled with water when the pump stops, it is possible to reduce load in re-operation and it can be expected to improve performance and durability of the pump.

Further, in the refrigerator and a water tank for a refrigerator, according to the present invention, the floater moves up/down along the intake channel or the intake unit in accordance with the water level in the water tank and the inlets formed in the intake unit can be selectively opened/closed by the movement of the floater.

Therefore, when the water level in the water tank is lower than the water level of the inlets, the floater moves down to close the inlets, whereas when the water level in the water tank is higher than the water level of the inlets, the floater moves up to open the inlets, such that water can flow inside.

Therefore, when water is completely discharged out of the water tank or the water level is low, the floater closes the inlets and air as well as water cannot flow inside, such that it is possible to air from flowing inside with water or remove water supply defects which may be generated by the air flowing inside.

Therefore, the user can prevent water from splashing due to air when taking out water from the dispenser, and remove the problem that water containing air is supplied to the ice maker and the amount of ices is not uniform.

Further, it can be expected to improve durability of the pump, in addition to preventing the performance of the pump from decreasing due to the air flowing in the pump.

Further, in the refrigerator according to the embodiment of the present invention, the pump operates in the reverse direction in order to remove the water remaining in the water supply channel when the use of the dispenser is stopped. Therefore, the water in the water supply channel returns to the water tank.

In this case, the internal pressure of the water supply channel becomes relatively low when the pump operates in the reverse direction, such that the opening/closing member in the water supply channel is opened and water or air returning through the water supply channel is discharged outside the water supply channel through the opening/closing member. In this case, since the opening/closing member is positioned in the water tank, the discharged water and air flow into the water tank.

Therefore, it is possible to reduce load in the pump which may be generated when the pump operates in the reverse direction, such that the remaining water can return to the water tank without temporarily stopping.

Further, since the air flowing inside with the water when the pump operates in the reverse direction is discharged through the opening/closing member, it is possible to prevent the load applied to the pump from excessively increasing.

Further, air does not exist in the water supply channel outside the water tank by completely sucking the water and air in the water supply channel. Therefore, it is possible to prevent water from splashing due to the air remaining in the water supply channel, in re-supply of water by the dispenser.

Therefore, it can be expected to generally improve the usable performance and sensitive performance of the dispenser.

MODE FOR THE INVENTION

Hereinafter, specific embodiments of the present invention are described in detail with reference to the accompanying drawings. However, the scope of the present invention is not limited to the embodiments but other retrogressive inventions or other embodiments included in the scope of the present invention can be easily proposed by adding, modifying, removing, etc. other components.

A side-by-side type of refrigerator with a cold compartment and a freezing compartment at the left and right sides, respectively, is exemplified hereafter for the convenience of describing and understanding.

Figure 1:
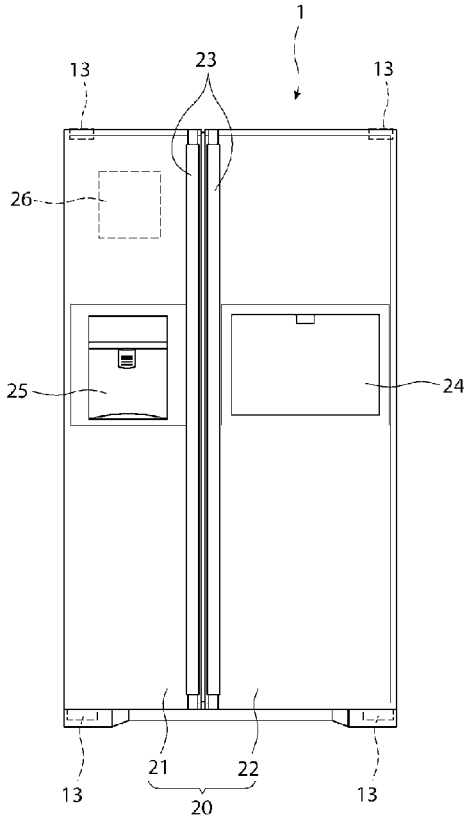
FIG. 1 is a front view of a refrigerator according to a first embodiment of the present invention.
Figure 2:
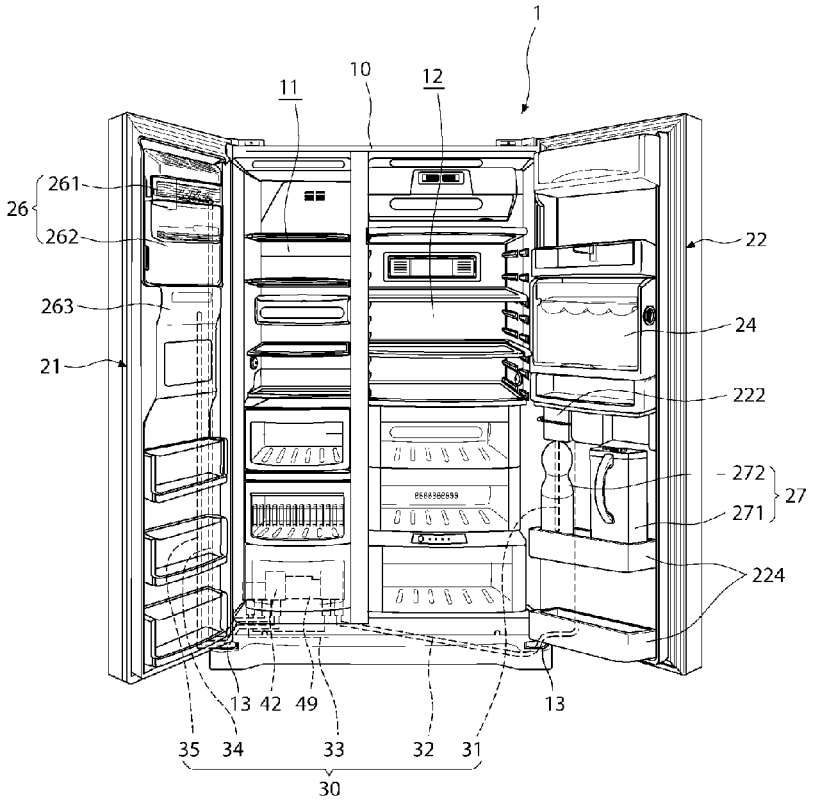
FIG. 2 is a front view of the refrigerator according to the first embodiment of the present invention, with the doors open.

FIG. 1 is a front view of a refrigerator according to a first embodiment of the present invention. FIG. 2 is a front view of the refrigerator according to the first embodiment of the present invention, with the doors open.

Referring to FIGS. 1 and 2, a refrigerator 1 according to a first embodiment of the present invention has the outer shape formed by a cabinet 10 where a storage space is defined and a door 20 opening/closing the storage space.

The cabinet 10 is opened at the front and the inside is divided to the left and right by a barrier, such that a freezing compartment 11 and a cold compartment 12 are formed. Further, components for accommodating food, such as a plurality of shelves and drawers, are provided in the freezing compartment 11 and the cold compartment 12.

The door 20 is composed of a cold compartment door 22 and a freezing compartment door 22 to close the cold compartment 12 and the freezing compartment 11, respectively, and rotatably connected to the cabinet 10 by hinges 13. Therefore, the cold compartment 12 and the freezing compartment 11 can be selectively opened/closed by rotation of the cold compartment door 22 and the freezing compartment door 21.

The cold compartment door 22 and the freezing compartment door 21 are provided with a door handle 23, respectively. Further, a home bar 24 may be formed in the cold compartment door 22 and a dispenser 25 allowing for taking out drinking water and/or ices may be formed in the freezing compartment door 21.

Meanwhile, an ice maker assembly 26 is disposed on the rear of the freezing compartment door 21. The ice maker assembly 26 is equipment that makes ices from water supplied from a water tank 27, which is described below, and disposed above the dispenser 25.

The ice maker assembly 26 may be composed of an ice maker 261 that makes ices by freezing supplied water and an ice bank 262 that is disposed under the ice maker 261 to store the ices.

The ice maker 261 is automatically supplied with water for making ices, formed to automatically deliver the ices made by cold air to the ice bank 262, and has the same configuration as a common ice maker 261.

The ices made by the ice maker 261 are stored in the ice bank 262 and can be supplied to the ice maker 261 through an ice chute connecting the ice bank 262 with the dispenser 25, when the dispenser 25 is operated.

Meanwhile, the water tank 27 is disposed on the rear of the cold compartment door 22. The water tank 27 is provided to store ice-making water and/or drinking water which are supplied to the ice maker 261 and/or the dispenser 25, and users can directly supply water into the water tank 27.

The water tank 27 may be positioned under the ice maker 261 and the dispenser 25 and the water stored therein can be supplied to the ice maker 261 or a water device 250 of the dispenser 25 by a pump 41, which is described below.

The water tank 27 may be disposed in the cold compartment 120, if needed, in which it may also be positioned under the water device 250.

The water tank 27 is detachably attached to the cold compartment door 22 and has a predetermined shape to be mounted on the rear of the cold compartment door 22 while it may be designed as an exclusive tank 271. Further, the water tank 27 may be a water bottle 272, which is in the market.

A plurality of baskets 224 are attached to the rear of the cold compartment door 22 and can be detached to adjust the vertical position. Further, any one of the baskets 224 may be formed to support the bottom of the water tank 27.

Further, a tank connector 222 combined with the water tank 27 is attached to the rear of the cold compartment door 22. The tank connector 222 are formed to be selectively connected with the mouth at the top of the water tank 27 and may be integrally formed with the rear of the cold compartment door 22 or may be detachably attached by specific members.

In detail, the tank connector 222 may be integrally fixed to the cold compartment door 22, in which the water tank 27 may be attached to the rear of the cold compartment door 22 by being combined with the tank connector 222.

Further, the tank connector 222 is made of a specific member and may be formed to the attached to the rear of the cold compartment door 22 after being combined with the water tank 27.

Meanwhile, the water tank 27, the ice maker 261, and the dispenser 25 are connected by a water supply channel 30, such that water can be supplied from the water tank 27 to the ice maker 261 and the dispenser 25.

The pump 41 and a valve 42 are disposed in the water supply channel 30. The water in the water tank 27 can be forcibly supplied to the ice maker 261 and the dispenser 25 by the pump, and can be selectively supplied to the ice maker 261 and the dispenser 25 in accordance with the operational states, by being divided by the valve 42.

The pump 41 and the valve 42 may be disposed in a machine room (not shown) disposed at the lower corner of the rear portion of the cabinet 10, and if needed, they may be disposed in the bottom of the cabinet 10 or at one side in the cold compartment door 22 or the freezing compartment door 12.

The water supply channel 30 may be composed of an intake channel 31 in the water tank 27, a pump input channel 32 connected to the input side 411 of the pump 41, a pump output channel 33 connecting the valve 42 with the output side 412 of the pump, an ice maker-sided channel 42 connecting the valve 42 with the ice maker 261, and a dispenser-sided channel 25 connecting the valve 42 with the dispenser 25.

The intake channel 31 is for sucking water in the water tank 27 and extends to the lower portion inside the water tank 27, when the water tank 27 is combined with the tank connector 222.

Further, the intake channel 31 is disposed inside the tank connector 222 and can be selectively connected with the water supply channel 30 in the cold compartment door 22 when the tank connector 222 is attached/detached. Further, it needed, a specific connection pipe that can be selectively connected with the intake channel 31 or the water supply channel 30 in the cold compartment door 22 may be further formed at the tank connector 222.

Meanwhile, the pump input channel 32 is connected from the cold compartment door 20 to the intake channel 31 and extends to the input side 411 of the pump 41, which is described below. In this configuration, when the pump 41 is disposed at one side in the cabinet 10, the pump input channel 32 may be guide from the cold compartment door 22 to the cabinet 10 across the hinge 12.

Further, the pump output channel 33 connects the pump 41 with the valve 42 and allows the water discharged from the pump 41 to flow to the valve 42 by connecting the output side 412 of the pump 41, which is described below, with the input side 421 of the valve 42, which is described below.

The ice maker-sided channel 34 and the dispenser-sided channel 35 are separate channels connected to the valve 42 and divided from one side of the valve 42 to extend to the ice maker 261 and the dispenser 25, respectively.

The ice maker-sided channel 34 and the dispenser-sided channel 35 may be guided across the hinge 13 at the freezing compartment door 21, or may extend to the ice maker 261 and the dispenser 25, respectively, after dividing across the hinge 13 in one pipe shape from the valve 42.

Figure 3:
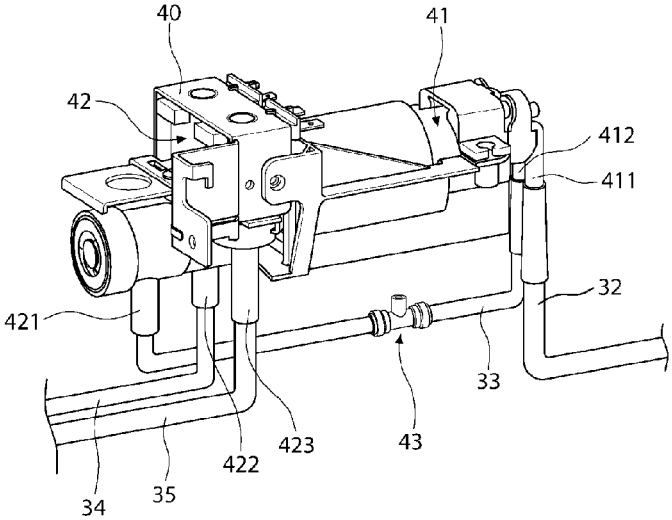
FIG. 3 is a partial perspective view of an assembly of a pump, a valve, and an air exhaust unit in the refrigerator according to the first embodiment of the present invention.

FIG. 3 is a partial perspective view of an assembly of the pump, the valve, and an air exhaust unit in the refrigerator according to the first embodiment of the present invention.

Referring to FIG. 3, the pump 41 and the valve 42 are combined in one assembly by a mounting member 40 and can be fixed to one side of the cabinet 10 or the door 20 by the mounting member 40. Further, the water supply channel 30 is connected to the pump 41 and the valve 42, such that water can be supplied from the water tank 27 to the ice maker 261 and the dispenser 25.

In detail, the pump input channel 32 is connected to the input side 411 of the pump 41 where the water is sucked from the water tank 27 and the pump input channel 32 is connected with the intake channel 31, such that the water can be sucked into the pump 41 from the water tank 27 by the operation of the pump 41.

Further, the pump output channel 33 connects the output side 412 of the pump 41 with the valve input side 421 through which water flows into the valve 42 such that the valve 42 and the pump 41 are connected and the water discharged from the pump 41 can be supplied to the valve 42.

Meanwhile, the valve 42 may have a first output side 422 connected with the ice maker-sided channel 34 for supplying water to the ice maker 261 and a second output side 423 connected with the dispenser-sided channel 35 for supplying water to the dispenser 25.

That is, the water flowing in to the valve 42 is selectively divided across the valve 42 in accordance with a control signal, such that it can be supplied to the ice maker 261 or the dispenser 25.

Meanwhile, an air exhaust unit 43 that discharges air in the water supply channel 30 to the outside is disposed in the pump output channel 33 connecting the valve 42 with the pump 41.

The air exhaust unit 43 is disposed between the pump output side 412 and the valve input side 421 and makes it possible to discharge the air passing through the air exhaust channel 43 or air mixed with the water to the outside.

The air exhaust channel 43 is generally formed in a substantially T-shape and has a channel where water and air can flow. Further, the air exhaust unit 43 may be composed of an input portion 431 in which water flows from the pump 41, an output portion 432 through which water from the input portion 431 is discharged, and an air exhaust portion 433 discharging the air in the air exhaust unit 43.

Figure 4:
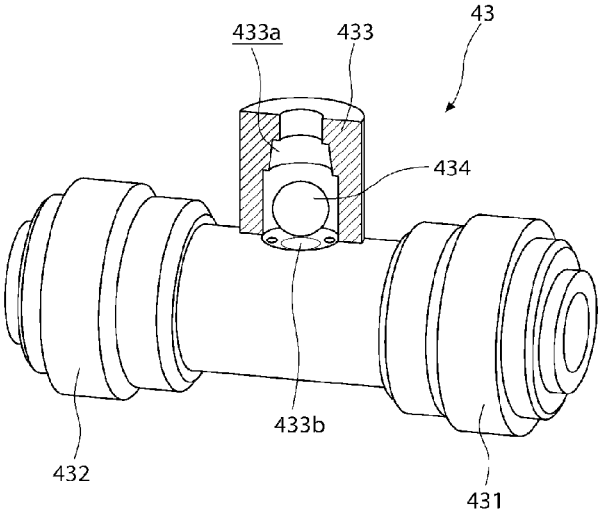
FIG. 4 is a partial-cut perspective view of the air exhaust unit according to the first embodiment of the present invention.

FIG. 4 is a partial-cut perspective view of the air exhaust unit according to the first embodiment of the present invention.

Referring to FIG. 4, the input portion 431 and the output portion 432 of the air exhaust unit 43 are formed to be connected with the water supply channel 30. That is, the ends of the input portion 431 and the output portion 432 are opened and may have common pipe-fitting structures such that the ends of the water supply channel 30 can be inserted and fixed.

Further, the input portion 431 is connected with the side of the water supply channel 30 which is connected to the pump output side 412 and the output portion 432 is connected with the side of the water supply channel 30 which is connected with the valve input side 421. Obviously, when the valve 42 is not provided, the output portion 432 may be connected with the side of the water supply channel 30 which is connected with the ice maker 261 or the dispenser 25.

The input portion 431 and the output portion 431 may be formed in the same line while the water flowing inside through the input portion 431 can be discharged through the output portion 432.

Meanwhile, the air exhaust portion 433 is formed between the input portion 431 and the output portion 432. The air exhaust portion 433 extends between the input portion 431 and the output portion 432 and the channel inside the air exhaust portion 433 perpendicularly communicates with the channel between the input portion 431 and the output portion 432.

The air exhaust portion 433 extends outward between the input portion 431 and the output portion 432 and the open end of the air exhaust portion 433 may be positioned upward. Further, the air exhaust unit 43 may be disposed in the machine room to discharge air outside the refrigerator through the air exhaust portion 433.

Obviously, the air exhaust unit 43 may be disposed at other positions, not in the machine, as long as the open end of the air exhaust portion 433 can be positioned outside the refrigerator, or the air exhaust unit 43 may be disposed in the refrigerator and a specific channel connected with the air exhaust portion 433 may extend outside the refrigerator.

Meanwhile, an opening/closing member that selectively opens/closes the channel inside the air exhaust portion 433 is disposed in the air exhaust portion 433. The opening/closing member 434 is provided to discharge air through the air exhaust portion 433 by opening the channel in the air exhaust portion 433 when air flows into the air exhaust portion 433, and prevent water from being discharged to the air exhaust portion 433 by closing the air exhaust portion 433 when water flows inside.

In detail, the opening/closing member 434 is formed in a ball shape and may be made of resin, such as ABS. Therefore, when it is made of a floatable material and comes in contact with water, it moves upward to close the opening of the air exhaust portion 433, while it is positioned at the lowermost position when not being in contact with water such that air can be discharged through the opening of the air exhaust portion 433.

Obviously, the opening/closing member 434 may be formed in a hollow part, if needed, such that it can structurally move upward when water flows inside, even if it is made of a non-floatable material.

On the other hand, the inner diameter of the air exhaust portion 433 is larger than the diameter of the opening/closing member 434 and a closing portion 433*a* inclined or stepped to close the outlet of the air exhaust portion 433 when the opening/closing member 434 moves upward may be formed at the upper portion of the air exhaust portion 433.

Further, a support portion 433*b* that supports the opening/closing member 434 such that the opening/closing member 434 is maintained in the air exhaust portion 433, when the opening/closing member 434 is positioned at the lowermost position, may be further formed at the lower portion of the air exhaust portion 433.

The support portion 433*b* is formed in a net shape or a plate shape to support the opening/closing member 434 such that the opening/closing member cannot move down, and may communicate with the channel between the input portion 431 and the output portion 432 such that water or air can flow inside.

Therefore, the water that flows in the input portion 431 and is discharged through the output portion 432 and the air contained in the water can flow into the air exhaust portion 433 and the air exhaust portion 433 is selectively opened/closed by vertical movement of the opening/closing member 434 in the air exhaust portion 433, thereby discharging the air.

Figure 5:
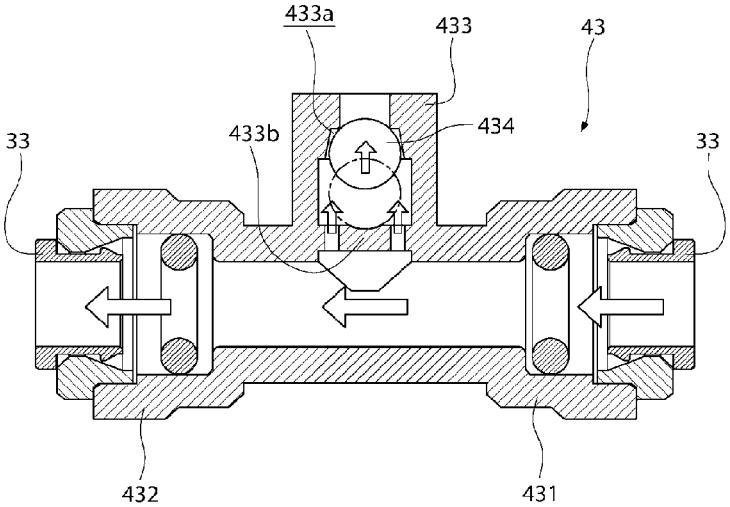
FIGS. 5 and 6 are cross-sectional views schematically showing the state of the air exhaust unit when water is supplied in the refrigerator according to the first embodiment of the present invention.
Figure 6:
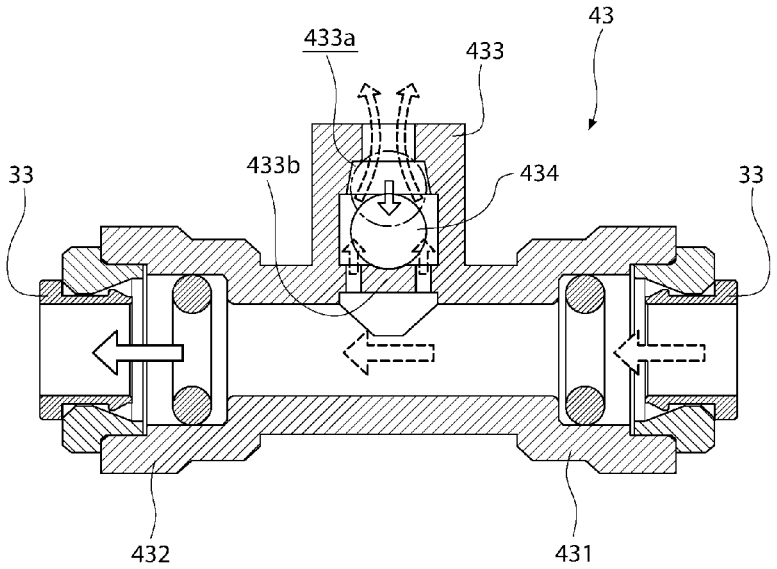

FIGS. 5 and 6 are cross-sectional views schematically showing the state of the air exhaust unit when water is supplied in the refrigerator according to the first embodiment of the present invention.

Referring to FIGS. 5 and 6, it needs to fill the water tank 27 with water, combine the tank connector 222 with the water tank 27, and attach the water tank 27 to the rear of the cold compartment door 22, in order to use ice-making water and drinking water. The water tank 27 may be a water bottle, in which the tank connector 222 is combined with the bottle by opening a common water bottle without a specific water supply process.

The intake channel 31 is positioned inside the water tank 27 by the combination of the water tank 27 and the tank connector 222, such that it is possible to suck the water in the water tank 27, and the intake channel 31 is connected with the pump input channel 32 by mounting the tank connector 222, such that water can be supplied to the ice maker 261 and the dispenser 25.

In this position, the pump 41 is operated, when a water supply signal is transmitted to the ice maker 261 to make ices or the dispenser 25 is operated to take out drinking water.

The water in the water tank 27 is sucked through the intake channel 31 and sucked into the pump 41 through the pump input channel 32, by the operation of the pump 41.

Further, the water discharged from the pump 41 through the pump output channel 33 is supplied to the valve 42 through the air exhaust unit 43. When a signal for supplying ice-making water is transmitted, the first output side of the valve 42 is opened and the water supplied to the valve 42 is supplied to the ice maker 261 through the ice maker-sided channel 34.

Further, when a signal for taking out drinking water, the second output side 412 is opened and the drinking water is supplied to the dispenser 25 through the dispenser-sided channel 35 to be taken out.

Meanwhile, the air exhaust portion 433 is closed, as shown in FIG. 5, when the water flows into the input portion 431 through the pump 41 and the air exhaust unit 43 is filled with the water, by the operation of the pump 41.

In detail, when air is not contained in the water that flows inside through the input portion 431 of the air exhaust unit 43 and is then discharged to the output portion 432, the water flowing into the input portion 431 can flow into the air exhaust portion 433 and the opening/closing member 434 is moved upward by the water flowing in the air exhaust portion 433.

When the opening/closing member 434 completely moves up, the opening/closing member 433 is in contact with the closing portion 433*a*, such that the channel in the air exhaust portion 433 is closed and the water flowing in the air exhaust portion 433 cannot be discharged outside and can be supplied to the valve 42 through the output portion 432.

On the other hand, when air is sucked by a small water level in the water tank 27 or abnormal operations, when the pump 41 operates, or when air is sucked with the water, the air exhaust portion 433 is opened and the air can be discharged, as shown in FIG. 6.

In detail, when air is contained in the water flowing into the air exhaust unit 43 through the pump 41, the air in the water passes the air exhaust portion 433 while flowing to the output portion 432.

In this case, as the air passes the air exhaust portion 433, the opening/closing member 434 is kept on the support portion 433*b* by its own weight and the channel in the air exhaust portion 433 is kept open.

That is, the air can be discharged from the air exhaust unit 43 to the outside through the air exhaust portion 433 and water without air can be discharged to the output portion 432. Therefore, water with air removed can be supplied to the valve 42, such that it can also be supplied to the ice maker 261 and the dispenser 25.

Obviously, the air exhaust portion 433 is kept open by the opening/closing member 434 and air can be discharged, even if only air, not water, is sucked by the operation of the pump 41.

As described above, the air, such as bubbles, in the water passing through the air exhaust unit 43 is discharged through the air exhaust portion 433, such that the valve 42 and the water supply channel 30 after the air exhaust unit 43 are filled with only water, while the water remaining in the water supply channel 30 can flow into the pump 41, when the pump 41 stops, such that the pump 41 can operate under relatively small load when being operated again.

The structure of the water tank for preventing air from being mixed and supplied through the water tank is described hereafter.

Figure 7:
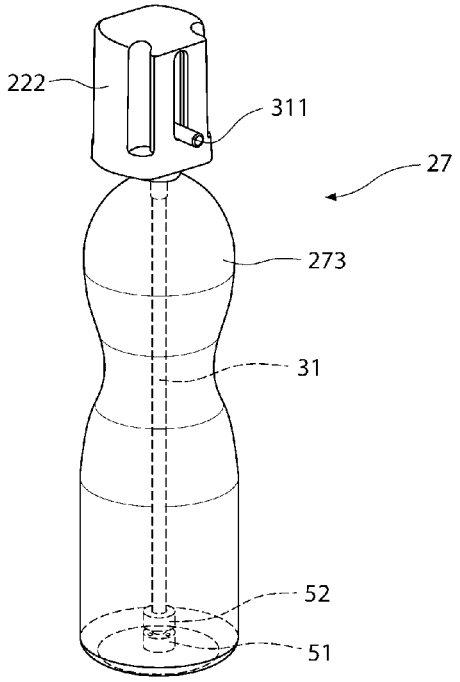
FIG. 7 is a perspective view of a water tank according to a second embodiment of the present invention.
Figure 8:
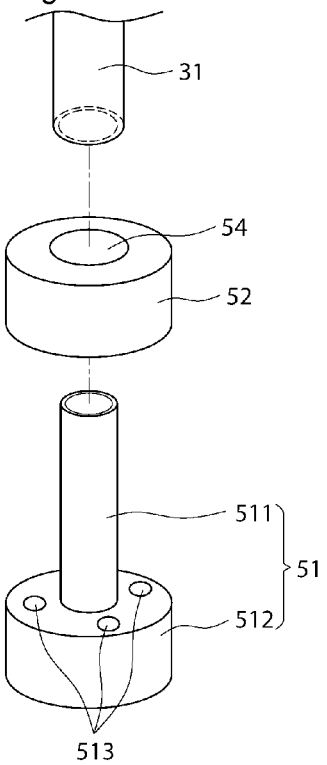
FIG. 8 is an exploded perspective view of an intake unit according to the second embodiment of the present invention.

FIG. 7 is a perspective view of a water tank according to a second embodiment of the present invention. FIG. 8 is an exploded perspective view of an intake unit according to the second embodiment of the present invention.

Referring to FIGS. 7 and 8, the water tank 27 has an outer shape defined by a body 273 and the body 273 may be a PET bottle that can be combined with the tank connector 222 or a container manufactured to be able to be combined with the tank connector 222.

Further, the water tank 27 is opened at the top and the opening is connected to the tank connector 222.

An intake channel 31 is formed inside the body 273. The intake channel 31 is a pipe for sucking water in the body 273 and extends to the bottom or close to the bottom of the body 273.

The intake channel 31 may communicates with a connection pipe 311 in the tank connector 222. The connection pipe 333 is selectively connected with the water supply channel 30 in the cold compartment door 220, that is, the pump input channel 32, when the tank connector 222 is detached/attached from/to the cold compartment door 220, and can be connected with the intake channel 31.

The connection pipe 311 may be individual from the intake channel 31 to the connected thereto when the water tank 27 is mounted, or if needed, it may be formed in one unit with the intake channel 31.

On the other hand, an intake unit 51 is disposed at the lower end of the intake channel 31. The intake unit 15 is provided to allow the water in the body 273 to selectively flow into the intake channel 31 and may communicate with the intake channel 31 at the lower end of the intake channel 31.

In detail, the intake unit 51 may be composed of an extender 511 that extends upward in a pipe shape and a seat 512 that is formed at the lower end of the extender 511 to seat a floater 52, which is described below.

The extender 511 formed vertically long to guide the floater 52 moving up/down, which is described below. The upper end of the extender 511 may be formed to be connected with the intake channel 31 such that the intake unit 51 communicates with the intake channel 31.

The seat 512 may be formed under the intake channel 31 in an outer diameter larger than the outer diameter of the extender 511 to seat the floater 52 thereon, which is described below.

Inlets 513 in which the water in the body flow may be formed on the outer side and a channel that guides the inflow water to the intake channel 31 is formed in the seat 512.

The inlets 513 may be formed on the top of the seat 512, in detail, the surface that comes in contact with the floater 52 that has moves to the lowermost position, which is described below. A plurality of the inlets 513 may be formed or one inlet 513 may be formed long on the top of the seat 512.

Further, a filter 514 is disposed in the intake unit 51. The filter 514 is provided to filter the water in the intake unit 51 and is disposed in the channel in the intake unit 51 to supply filtered water to the intake channel 31.

Meanwhile, the floater 52 is disposed at one side of the intake unit 51. The floater 52 may be made of a floatable material or may have a structure filled with air to be floatable, and may be formed to move up/down along the extender 511, with the center fitted on the extender 511.

That is, a through-hole 521 is formed at the center of the floater 52 and the inner diameter of the through-hole 521 is determined such that the floater 52 corresponding to the outer diameter of the extender 511 can move up/down along the extender 511 in accordance with the water level in the body 273.

In this configuration, when the outer diameter of the intake channel 31 corresponds to the outer diameter of the extender 511 or is smaller than the inner diameter of the through-hole 521, the floater 52 can move up/down along the extender 511 and the intake channel 31. Further, when the outer diameter of the intake channel 31 is larger than the inner diameter of the through-hole 521, the floater 52 can move up/down along only the extender 511.

The floater 52 is formed to have a transverse cross-section corresponding at least to the transverse cross-section of the seat 512 to fully cover the inlets 513 when the floater 52 is seated on the seat 512.

Therefore, when the water level in the body 273 is small, the floater 52 is seated on the seat 512 and closes the inlets 513, such that air as well as water is prevented from flowing through the intake channel 31.

Meanwhile, it may be preferable that the intake unit 51 is integrally formed with the intake channel 31. That is, the extender 511 and the seat 512 may be integrally formed at the lower end of the intake channel 31 and the floater 52 may be fitted on the upper end of the intake channel 31.

Water supply in the refrigerator having the above configuration according to the present invention is described hereafter in detail with reference to the drawings.

Figure 9:
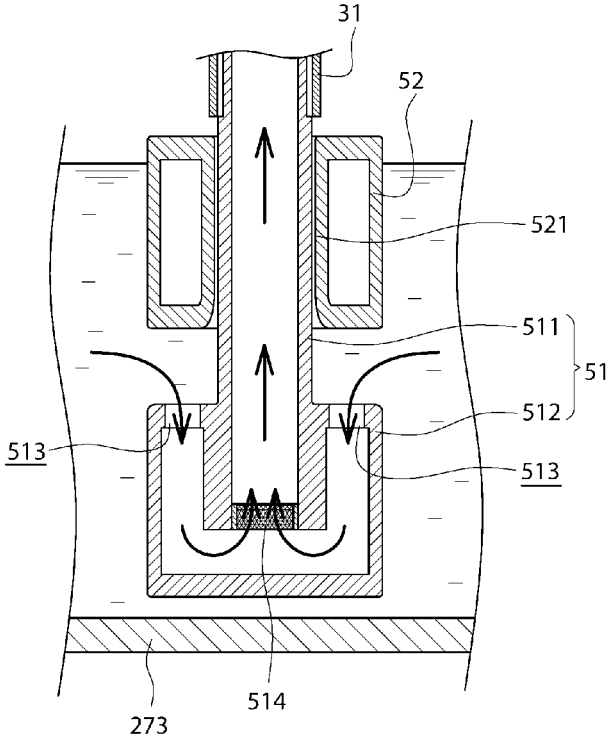
FIGS. 9 and 10 are longitudinal cross-sectional view schematically showing water supply state in the refrigerator according to the second embodiment of the present invention.
Figure 10:
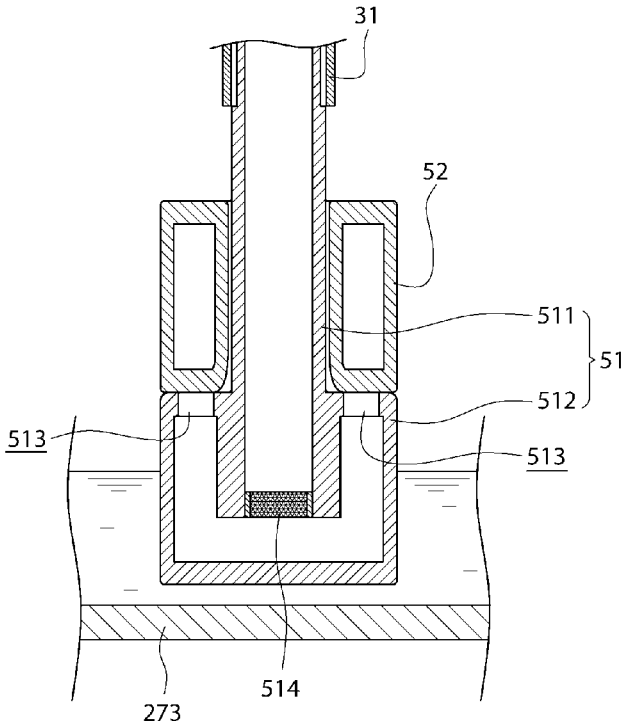

FIGS. 9 and 10 are longitudinal cross-sectional view schematically showing water supply state in the refrigerator according to the second embodiment of the present invention.

Referring to FIGS. 9 and 10, it needs first to fill the body of the water tank 27 with water, combine the tank connector 222 with the water tank 27, and attach the water tank 27 to the rear of the cold compartment door 220, in order to use ice-making water and drinking water. The water tank 27 may be a water bottle, in which the tank connector 222 is combined with the bottle by opening a common water bottle without a specific water supply process.

The intake channel 31 can be connected to the water supply channel 30 by the combination of the water tank 27 and the tank connector 222, such that water can be supplied to the ice maker 261 and the dispenser 25 by the operation of the pump 41.

In this position, the pump 41 is operated, when a water supply signal is transmitted to the ice maker 261 to make ices or the dispenser 25 is operated to take out drinking water.

Meanwhile, the body 273 is sufficiently filled with water, as shown in FIG. 5, the water level is higher than the inlets 513 of the intake channel 51 and the floater is positioned at the lowermost position, such that the inlets 513 are open.

In this state, as the pump 41 operates, the water in the body 10 can flow into the intake unit 51 through the inlets 513, can be filtered through the filter 514, and can flow into the intake channel 31.

The water flowing inside through the intake channel 31 flows along the water supply channel 30 through the connection pipe 311, and can be supplied to the ice maker 261 or the dispenser 25 through the pump 41 and the valve 42.

Meanwhile, when the water is continuously supplied to the ice maker 261 and the dispenser 25 such that the water in the body 273 is almost used, as shown in FIG. 6, the water lever in the body 273 is lower than the water level in the intake channel 31.

In this state, the floater 52 moves to the lowermost position and is seated on the seat 512, such that the inlets 513 formed in the intake unit 51 are closed by the floater 52.

That is, when the floater 52 is seated on the seat 512, the bottom of the floater 52 is in contact with the top of the seat 512, such that the inlets 513 formed through the top of the seat 512 is covered by the bottom of the floater 52.

Therefore, air as well as water cannot flows through the inlets 513, even though the pump 41 operates. Since the water level in the body 273 is low, it is possible to preclude a situation where water and air are mixed.

On the other hand, the present invention may be implemented by various embodiments, other than the embodiments described above, and other embodiments of the present invention are described hereafter.

Another embodiment of the present invention is characterized in that the inlets are formed to be open to the sides of the intake unit. The other configuration of this embodiment of the present invention are the same as those of the embodiment described above, except for the intake unit, such that the same configurations are not provided in detail and given the same reference numerals.

Figure 11:
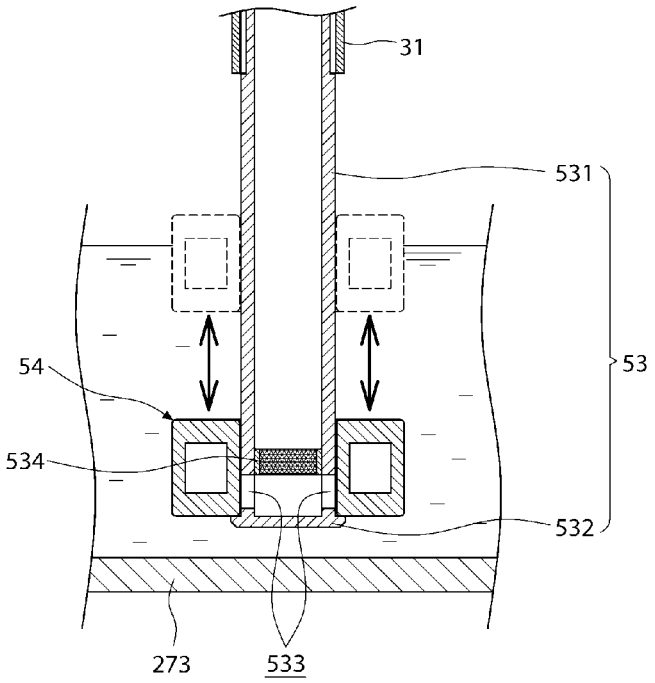
FIG. 11 is a longitudinal cross-sectional view of an intake unit according to a third embodiment of the present invention.

FIG. 11 is a longitudinal cross-sectional view of an intake unit according to a third embodiment of the present invention.

Referring to FIG. 11, an intake unit 53 according to the third embodiment of the present invention is composed of an extender 521 connected with the intake channel 31 and a seat 532 formed at the lower end of the extender 531 to seat the floater 52.

The extender is formed vertically long and inlets 533 are formed around the lower end of the extender 531. A plurality of inlets 533 may be formed as passages through which water in the body 273 flows and may have a diameter smaller than the vertical height of a floater 54 to be closed by the floater 54.

Meanwhile, a filter 534 that filters the water flowing inside may be disposed in the intake channel 31 and may be positioned above the inlets 533.

The outer diameter of the extender may be determined to correspond to the inner diameter of the floater 54 and the floater 54 may be formed to move up/down along the extender 531.

Meanwhile, the seat 532 protrudes outward from the lower end of the extender 531 and comes in contact with the floater 54 that has moves to the lowermost position to hold the floater 54, such that it is positioned such that the floater 54 can close the inlets 533, when the floater 54 is seated on the seat 532.

Therefore, when the water level in the body 273 is higher than the inlets 533, the floater 54 is positioned on the extender 531, above the inlets 533, such that water can flow from the body 273 into the inlets 533.

On the other hand, when the water level in the body 273 is lower than the inlets 533, the floater 54 is seated on the seat 533, such that the inlets 533 formed in the extender 531 can be completely closed.

On the other hand, the present invention may be implemented by various embodiments, other than the embodiments described above, and another embodiment of the present invention is described hereafter.

Another embodiment of the present invention is characterized in that a seat is formed at an angle in the intake unit and inlets are formed through the inclined surface. The other configuration of this embodiment of the present invention are the same as those of the embodiment described above, except for the intake unit and the floater, such that the same configurations are not provided in detail and given the same reference numerals.

Figure 12:
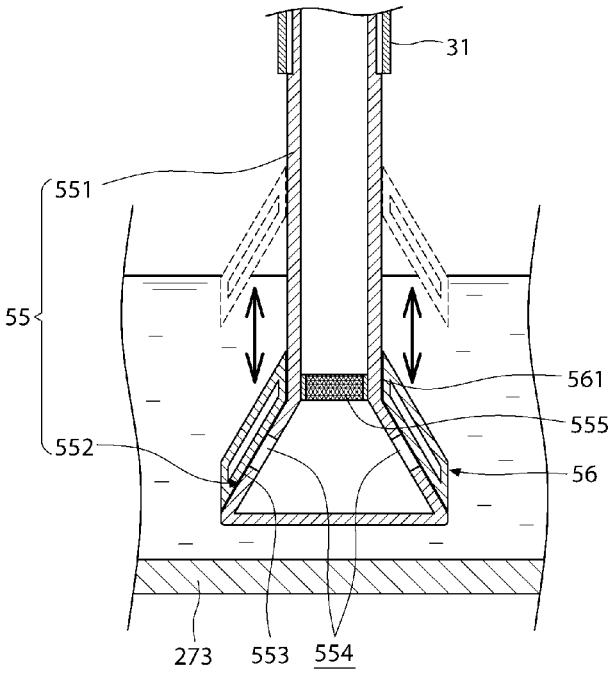
FIG. 12 is a longitudinal cross-sectional view of an intake unit according to a fourth embodiment of the present invention.

FIG. 12 is a longitudinal cross-sectional view of an intake unit according to a fourth embodiment of the present invention.

Referring to FIG. 12, an intake unit 55 according to the fourth embodiment of the present invention is composed of an extender 551 connected to the lower end of the intake channel 31 and a seat 552 formed at the lower end of the extender 551 to seat a floater 56, which is described below.

The extender 551 is formed vertically long the passing through the floater 56, which is described below, and the floater 56 that is floatable can move up/down along the extender 551.

Further, the seat 552 has a larger outer diameter than the extender 551 and has an inclined surface 553 having an increasing outer diameter at the lower end of the extender 551. That is, the seat 552 has the inclined surface 553, such as the circumference of a cone, and inlets 554 through which water flows inside from the body 273 may be formed through the inclined surface 553. A plurality of inlets 554 may be formed through the inclined surface 553 to be open at an angle. Further, the filter 555 may be disposed in the channel in the intake unit 55.

Meanwhile, the floater 56 is fitted on the extender 551 and has an inner diameter corresponding to the outer diameter of the extender 551 to be able to move up/down. Further, the bottom 56 that comes in contact with the seat 552 has an inclined surface 553 corresponding to the bottom of the floater 56.

That is, the bottom of the floater 56 also has the inclined surface 553 corresponding to the circumference of a cone, such that when the floater 56 has moved to the lowermost position, the bottom of the floater 56 is in contact with the inclined surface 553 of the seat 552, thereby closing the inlets 554.

Therefore, when the water level in the body 273 is higher than the position of the inlets 554, the floater 56 is positioned on the extender 551, above the inlets 554, such that the inlets 554 are open.

When the inlets 554 are open and the pump 41 operates, the water in the body 273 flows into the inlets 554 and can flow into intake channel 31.

On the contrary, when the water level in the body 273 is lower than the position of the inlets 554, the floater 56 is positioned at the lowermost position and the bottom of the floater 56 is in contact with the inclined surface 553, such that the inlets 554 are closed.

With the inlets 554 closed, water and air cannot flows inside from the body 273, even if the pump 41 operates.

Hereinafter, a configuration that prevents water from remaining in the dispenser is described.

Figure 13:
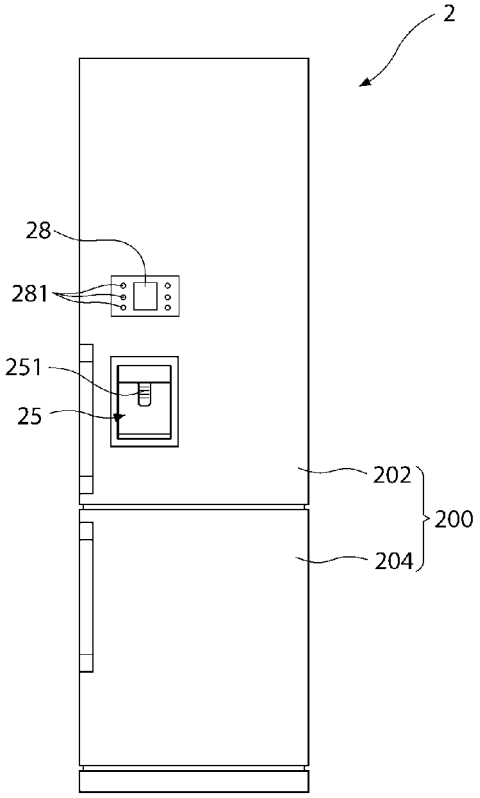
FIG. 13 is a front view of a refrigerator according to a fifth embodiment of the present invention.
Figure 14:
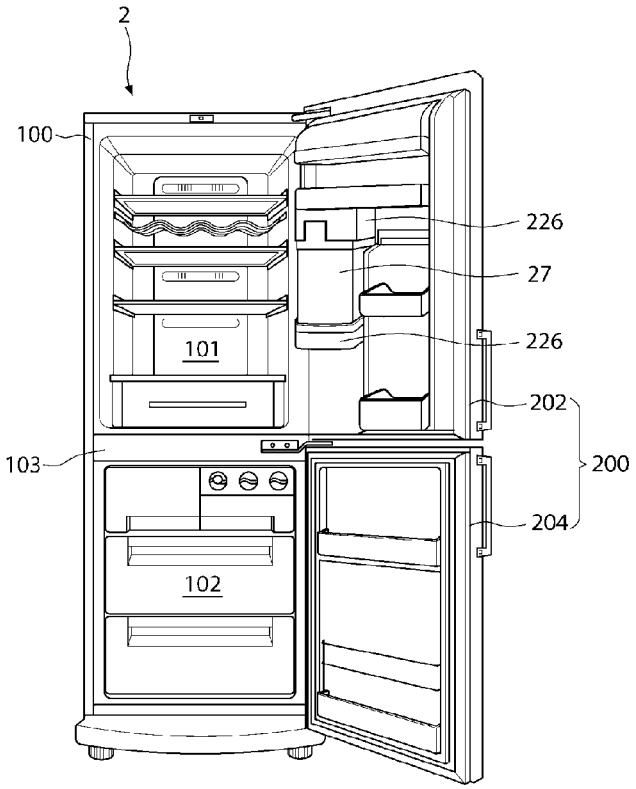
FIG. 14 is a front view of the refrigerator with the doors open.

FIG. 13 is a front view of a refrigerator according to a first embodiment. FIG. 14 is a front view of the refrigerator with the doors open.

Referring to FIGS. 13 and 14, the refrigerator 2 according to the present invention has an outer shape formed by a cabinet 10 defining a storage space and a door 200 opening/closing the storage space.

The storage space in the cabinet 100 is divided in a cold compartment 101 and a freezing compartment 102, at the upper and lower portions, respectively, by a separator 103. Further, components for accommodating food, such as a plurality of shelves and drawers, are provided in the freezing compartment 101 and the cold compartment 102.

The door 200 is composed of a cold compartment door 202 and a freezing compartment door 204 to selectively open/close the cold compartment 101 and the freezing compartment 102. Further, the cold compartment door 202 and the freezing compartment door 204 are hinged to the cabinet 100 to open/close the cold compartment 101 and the freezing compartment 102, respectively. Further, baskets may be attached to the rears of the cold compartment door 202 and the freezing compartment door 204 to accommodate food.

Meanwhile, a dispenser 25 may be provided in the cold compartment door 202. The dispenser 25 is provided to take out drinking water from the outside the refrigerator and disposed in the front of the cold compartment door 202.

Further, the dispenser 25 is further provided with an operation member 251 that users push to operate. The operation member 251 may have a lever type or button type structure. Further, the operation member 251 may be disposed in a depression of the dispenser to allow users to take driving water by pushing it with a cup or a container for taking the water.

Further, an operation portion 281 and a display 28 may be provided on the front of the cold compartment door 202. The operation portion 281 is for controlling the operation of the refrigerator 2 and the operational states of the refrigerator 2 can be shown by the display 28.

A water tank 27 stores water to be supplied is attached to the rear of the cold compartment door 202. The water tank 27 is connected with the dispenser 25 to supply water to the dispenser 25.

The water tank 27 has a size to store a sufficient amount of water such that the water can be supplied several times by the dispenser 25. Further, the water tank 27 is detachably attached to the rear of the cold compartment door 202.

For this configuration, a water tank mounting portion 226 is further formed on the rear of the cold compartment door 202. Therefore, it may be possible to fill the water tank 27 with water, after separating the water tank 27 from the water tank mounting portion 226, in order to supply water to the water tank 27.

Further, the water tank 27 may be in close contact to the water tank mounting portion 226 and the rear of the cold compartment door 202. Further, the water tank 27 may be implemented by attaching a PET bottle, such as common standard-sized water bottles, to the water tank mounting portion 226.

Figure 15:
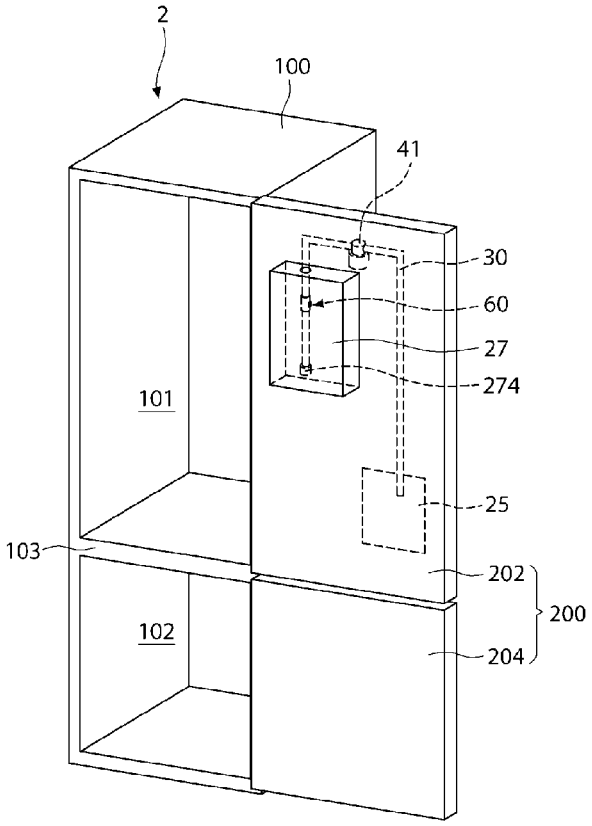
FIG. 15 is a perspective view schematically showing connection of a water supply channel, a water tank, and a dispenser according to the fifth embodiment of the present invention.

FIG. 15 is a perspective view schematically showing connection of a water supply channel, a water tank, and a dispenser according to the fifth embodiment.

Referring to FIG. 15, the water tank 27 is attached to the rear of the cold compartment door 202 and the dispenser 25 is formed on the front of the cold compartment door 202. Further, the water tank 27 and the dispenser 25 are connected by a water supply channel 30. In this configuration, when the water tank 27 is disposed above the dispenser 25, the water can be easily supplied to the dispenser 25 from the water tank 27 by its own weight.

A pump 41 id disposed in the water supply channel 30 between the water tank 27 and the dispenser 25. The pump 41 is provided to supply water stored in the water tank to the dispenser 25 and can operate in normal and reverse directions.

In detail, when the pump 41 operates in the normal direction, the water is supplied from the water tank 27 to the dispenser 25 through the water supply channel 30. Further, when the pump 41 operates in the reverse direction, the water and air which remain in the water supply channel 30 are supplied again to the water tank 27.

The pump 41 is operated in the normal direction by the operation of the operation member 251 for operating the dispenser 25 such that water can be taken from the dispenser 25. Further, the pump 41 operates in the reverse direction when a user gets a hand off the operation member 251 after finishing taking water from the dispenser 45.

Further, the water supply channel 30 extends from the inside of the water tank 27 to the outlet of the dispenser 25. Further, a filter 274 is disposed at the end of the water supply channel 30 in the water tank 27. Therefore, water in the water tank 27 can be filtered upon flowing in the water supply channel 30.

In addition to a portion of the water supply channel 30 which extends from the water tank 27 and the dispenser 25, the pump 41 in the water supply channel 30 is disposed inside the cold compartment door 202 in order not to be exposed to the front or rear from the cold compartment door 202. Further, the water supply channel 30 and the pump 41 may be disposed in an insulating material in the cold compartment door 202.

Meanwhile, an opening/closing member 60 is disposed in the water supply channel 30 in the water tank 27. The opening/closing member 60 is provided to reduce load in the pump 41 by opening when the pump 41 operates, and may have the configuration of a check valve that allows fluid to flow in one direction.

The opening/closing member 60 may be disposed in the water supply channel 40, corresponding to the highest water level Hw of the water tank 27. Further, the opening/closing member 60 may be formed in order not to sink in the water even if the water is at the highest level H2 in the water tank 27.

Meanwhile, the end of the water supply channel 30 passes the inlet of the water tank 27 when the water tank 27 is attached/detached. Therefore, the outer diameter of the filter 274 and the outer diameter of the water supply channel 30 including the opening/closing member 60 are determined smaller than the inner diameter of the inlet of the water tank 27.

Figure 16:
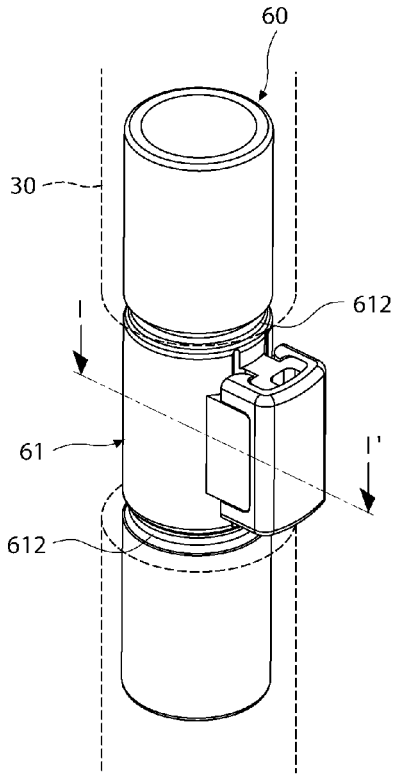
FIG. 16 is a perspective view an opening/closing member according to the fifth embodiment of the present invention.
Figure 17:
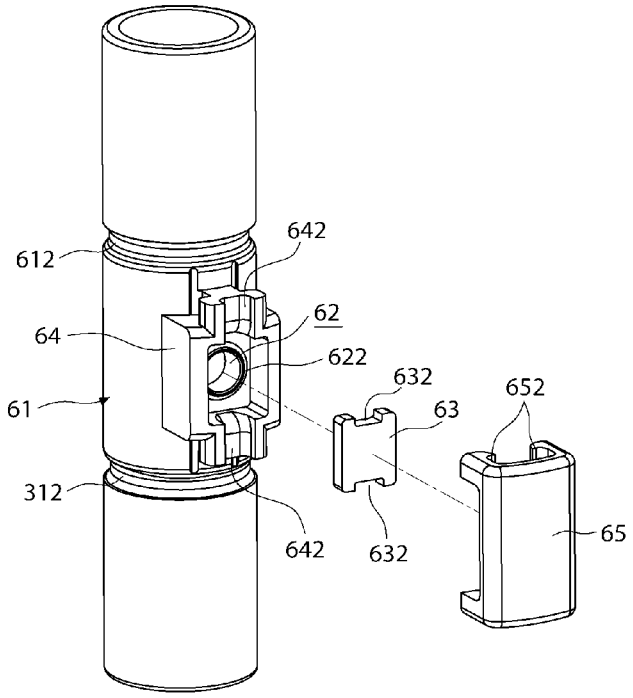
FIG. 17 is an exploded perspective view of the opening/closing member.

Further, FIG. 16 is a perspective view the opening/closing member according to the fifth embodiment. Further, FIG. 17 is an exploded perspective view of the opening/closing member. Further, FIG. 18 is a cross-sectional view taken along the line I-I of FIG. 16.

Figure 18:
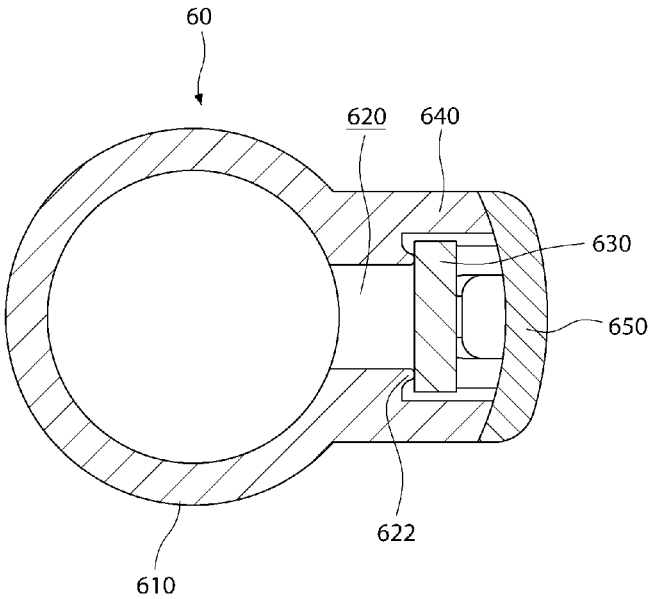
FIG. 18 is a cross-sectional view taken along line I-I of FIG. 16.

Referring to FIGS. 16 to 18, the opening/closing member 60 is formed in a pipe shape with one side selectively open and may be connected with the water supply channel 30.

The upper and lower ends of the water supply channel 30 are open such that the water supply channels 30 are connected. Further, a fixing groove 612 for fixing the water supply channel 30 is formed at the upper and lower portions of the opening/closing member 60. Therefore, the opening/closing member 60 forms a portion of the water supply channel 30.

The opening/closing member 60 may include a connection pipe 61 formed in a pipe shape to be connected with the water supply channel 30, an opening 62 that is open to the connection pipe 61, an opening/closing means 63 that opens/closes the opening 62, and a cover 65 that retains the opening/closing means 63.

In detail, the opening 62 is formed between the fixing grooves 612 at the upper and lower portions of the connection pipe 61. The opening 62 forms a passage through which water or air passing through the water supply channel 30 is discharged.

Further, an edge 622 protrudes around the opening 62. The edge 622 has a circular cross-section larger than the diameter of the opening 62 to close the opening/closing means. Therefore, the opening 62 can be closed by contact between the edge 622 and the opening/closing means 63.

A guide 64 is formed at the connection pipe 61, corresponding to the outer side of the opening 62. The guide 64 has a shape for receiving the opening/closing means 63 and protrudes sufficiently such that the water or air in the water supply channel 30 can be discharged while the opening/closing means 63 moves.

Meanwhile, outlets 642 are formed at both sides (upper and lower portion in FIG. 17) of the outer surface of the guide 64. The outlets 642 are formed through the guide 64 such that the water or air in the water supply channel 30 can be discharged outside through the outlets 642 when the opening/closing means 63 is open.

Further, the opening/closing means 63 may be made of rubber, silicon, or plastic, which has excellent sealing performance. Further, the opening/closing means 63 has a predetermined thickness to move forward/backward in the guide. Obviously, the opening/closing means 63 are formed to be able to close the opening 62.

Further, the upper and lower ends of the opening/closing means 63 which correspond to the outlets 642 are recessed, such that depressions are formed. Therefore, water and cold air that are discharged through the opening 62 can be guide to the outlets 642 and then discharged through the outlets 642.

Meanwhile, the open front of the guide 64 is closed by the cover. Hooks 652 are formed at the end of the cover 65 to be connected with one side of the guide 64. Further, when the cover 65 is combined, the outlets 642 are open above the guide 64, such that water or air can be smoothly discharged.

The operation of the refrigerator having the above configuration according to the fifth embodiment is described hereafter.

Figure 19:
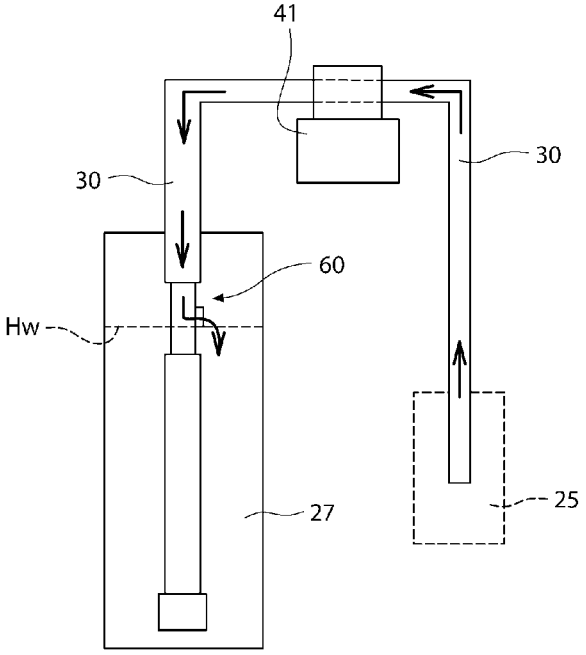
FIG. 19 is a view schematically showing the flow of water between the water tank and the dispenser.
Figure 20:
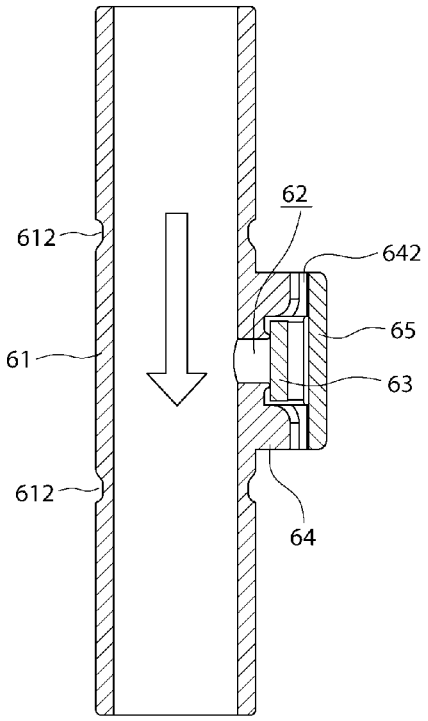
FIG. 20 is a view showing when the opening/closing member is closed.

FIG. 19 is a view schematically showing the flow of water between the water tank and the dispenser. Further, FIG. 20 is a view showing when the opening/closing member is closed. Further, FIG. 21 is a view showing when the opening/closing member is open.

Figure 21:
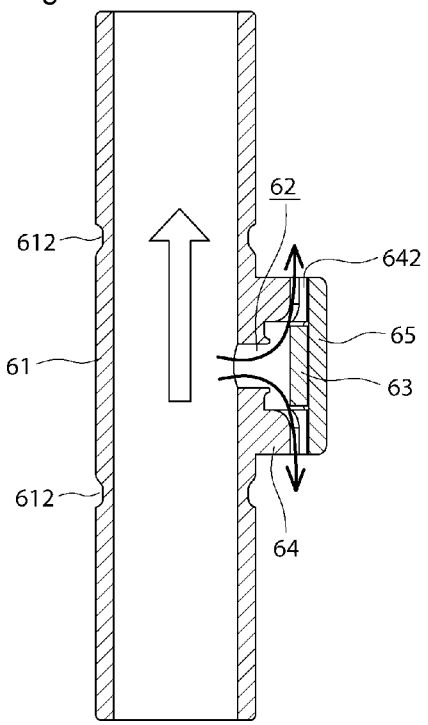
FIG. 21 is a view showing when the opening/closing member is open.

Referring to FIGS. 19 to 21, first, a user opens the cold compartment door 202, and fills the water tank 27 with water and attached to the water tank to the water tank mounting portion 226, when a sufficient amount of water is not in the water tank 27. Further, the user closes the cold compartment door 202 and prepares to take out water.

With the cold compartment door 202 closed, the water tank 27 is positioned on the rear of the cold compartment door 202, such that the water in the water tank 27 is cooled by the cold air in the refrigerator.

When the user presses the operation member 251 of the dispenser 25, with the cold compartment door 202 closed, the pump 41 is operated in the normal direction by an instruction from a controller. As the pump 41 operates in the normal direction, water is sucked into the water tank 27 at one side of the pump by negative pressure (intake pressure) and water can be supplied to the dispenser 25. Therefore, the user is continuously provided with water from the water tank 27 while operating the operation member 251.

Further, as the pump 41 operates in the normal direction, negative pressure is generated in the water supply channel 30 at the water tank 27. Therefore, the internal pressure of the water supply channel 30 becomes lower than the outside of the opening/closing member 60, such that the opening/closing means 63 closes the opening 62, as shown in FIG. 20. With the opening 62 closed, the water in the water tank 27 flows only through the water supply tank 30 and can be supplied to the water tank 27 through the pump 41.

Meanwhile, when the water is completely taken out through the dispenser 25, the operation of the operation member 251 of the dispenser 25 is finished. Further, when the user gets the hand off the operation member 251, the pump 41 is operated in the reverse direction by an instruction from the controller. As the pump 41 operates in the reverse direction, the water and air remaining in the water supply channel 30 for the dispenser 25 at one side of the pump 41 are sucked and can flow into the water tank 27.

In detail, negative pressure (intake pressure) is exerted in the water supply channel 30 for the dispenser 25, when the pump 41 operates in the reverse direction. Therefore, the water and the air in the water supply channel 30 for the dispenser can be sucked.

Further, positive pressure (exhaust pressure) is exerted in the water supply channel 30 for the water tank 27 at one side of the pump 41. Therefore, the water and air in the water supply channel 30 can be discharged into the water tank 27.

However, since water is always stored in the water tank 27, and particularly, the higher the water level in the water tank 27, the more the load is generated in order to discharge the water in the water supply channel 30 into the water tank 27.

Therefore, the opening/closing member 60 is opened, when the positive pressure is generated in the water supply channel 30 for the water tank 27 by the reverse operation of the pump 41. That is, as the pump 41 operates in the reverse direction, relatively higher pressure than the outside of the opening/closing member 60 is generated in the water supply channel 30 and the opening/closing means 63 is pushed outward.

As the opening 62 is opened, the water and air in the water supply channel 30 can be discharged outside the opening/closing member 60. That is, the water and air passing through the opening 62 can be discharged outside the water supply channel 30 through the outlets 642 in the guide 64.

Further, since the opening/closing member 60 is positioned in the water tank 27, the water and air discharged outside the opening/closing member 60 can be naturally supplied into the water tank 27.

Further, since the opening/closing member 60 is positioned above the highest water level of the water tank 27, load due to the stored water is not generated in the opening/closing member 60, such that it can smoothly move.

On the other hand, the refrigerator according to the present invention may be implemented by various embodiments, other than the embodiments described above. A sixth embodiment of the present invention is described hereafter.

The sixth embodiment has the same configurations as the fifth embodiment, except for the structure of the opening/closing member, such that the same configurations are given the same reference numerals and the detailed description is not provided.

Figure 22:
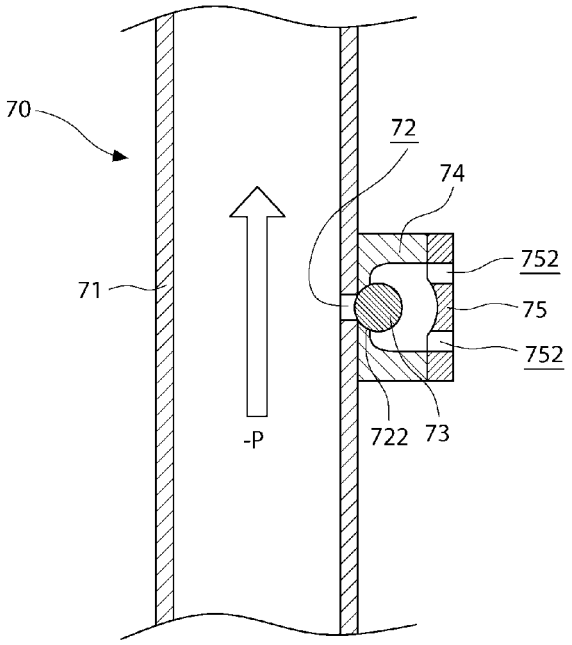
FIGS. 22 and 23 are views showing the operation of an opening/closing member according to a sixth embodiment of the present invention.
Figure 23:
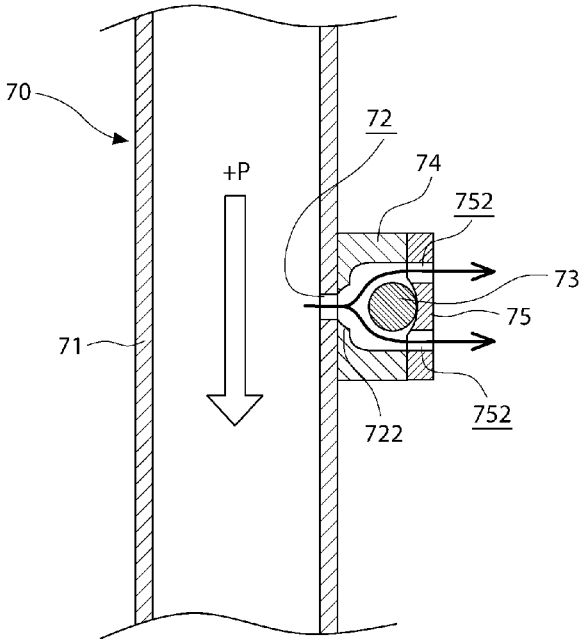

FIGS. 22 and 23 are views showing the operation of an opening/closing member according to the sixth embodiment.

Referring to FIGS. 22 and 23, an opening/closing member 70 according to the sixth embodiment may include a connection pipe 71 connected to the water supply channel 30 to form a passage for water and air, an opening 72 formed through the connection pipe 71, an opening/closing means 73 that opens/closes the opening 72, and a guide 74 that receives the opening/closing means 73, and a cover 75 that closes the guide 74.

In detail, the upper and lower ends of the connection pipe 71 are connected to the water supply channel 30 to form a portion of the water supply channel 30. Further, the opening 71 communicates with the inside of the connection pipe 71. A seat 722 is depressed around the opening 72 to seat the spherical opening/closing means 73.

Further, the guide 74 provides a space such that the opening/closing means 73 can be moved by pressure in the water supply channel 30. The cover 75 closes the open front of the guide 74 and retains the opening/closing means 73. Further, outlets 752 are formed in the cover 75 such that water or air can be discharged when the opening 72 is open.

The opening/closing member 70 having the configuration described above generates negative pressure in the water supply channel 30 for the water tank 27 at one side of the pump 41, when the pump 41 operates in the normal direction. Therefore, as shown in FIG. 10, the opening/closing member 73 closes the opening 72, such that water flows through the water supply channel 30 and is supplied to the dispenser 25.

Further, positive pressure is generated in the water supply channel for the water tank 27 at one side of the pump 41, when the pump 41 operates in the reverse direction. Therefore, as shown in FIG. 11, the opening/closing means 73 moves to open the opening 72, such that the water and air in the water supply channel 30 can be discharged into the water tank 27 through the outlets 752 of the opening/closing member 70.

On the other hand, the refrigerator according to the present invention may be implemented by various embodiments, other than the embodiments described above. A seventh embodiment of the present invention is described hereafter.

The seventh embodiment has the same configurations as the fifth embodiment, except for the structure of the opening/closing member, such that the same configurations are given the same reference numerals and the detailed description is not provided.

Figure 24:
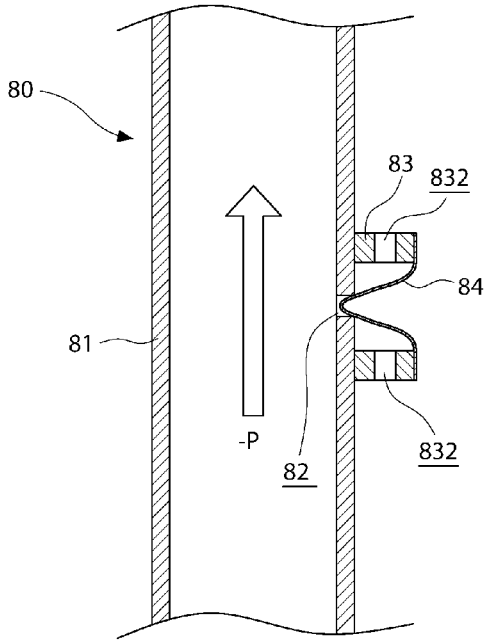
FIGS. 24 and 25 are views showing the operation of an opening/closing member according to a seventh embodiment of the present invention.
Figure 25:
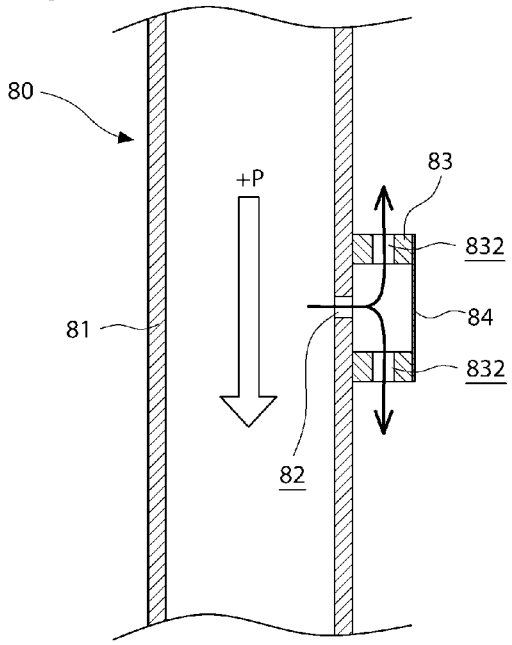

FIGS. 24 and 25 are views showing the operation of an opening/closing member according to the seventh embodiment.

Referring to FIGS. 24 and 25, an opening/closing member 80 according to the seventh embodiment may include a connection pipe 81 connected to the water supply channel 30 to form a passage for water or air, an opening 82 formed through the connection pipe 81, a protrusion 83 protruding outward from the opening 82 and having outlets 832, and an opening/closing means 84 that opens/closes the opening 82.

In detail, the upper and lower ends of the connection pipe 81 are connected to the water supply channel 30 to form a portion of the water supply channel 30. Further, the opening 82 communicates with the inside of the connection pipe 81.

The protrusion 83 protrudes at a predetermined length around the opening 82. Further, the outlets 832 that are open to the outside are formed through the protrusion 83. The opening/closing means 84 that can elastically deform is disposed at the end of the protrusion 83.

The opening/closing means 84 is formed in a sheet or bag shape to close the open front of the opening 83. Further, the opening/closing means 84 is made of rubber or vinyl, which can be freely elastically deformed by pressure, to selectively close the opening 82.

Therefore, negative pressure is generated in the water supply channel 30 for the water tank 27 at one side of the pump 41, when the pump 41 operates. Therefore, as shown in FIG. 12, the opening/closing means 84 extends to the water supply channel 30, which is at relative low pressure, and closes the opening 82, such that water flows through the water supply channel 30.

Further, positive pressure is generated in the water supply channel for the water tank 27 at one side of the pump 41, when the pump 41 operates in the reverse direction. Therefore, as shown in FIG. 11, the opening/closing means 84 is elastically restored and the opening 82 is opened, such that the water and air in the water supply channel 30 can be discharged into the water tank 27 through the outlets 752 of the opening/closing member 80.

On the other hand, the refrigerator according to the present invention may be implemented by various embodiments, other than the embodiments described above. An eighth embodiment of the present invention is described hereafter.

The eighth embodiment has the same configurations as the fifth embodiment, except for the structure of the opening/closing member, such that the same configurations are given the same reference numerals and the detailed description is not provided.

Figure 26:
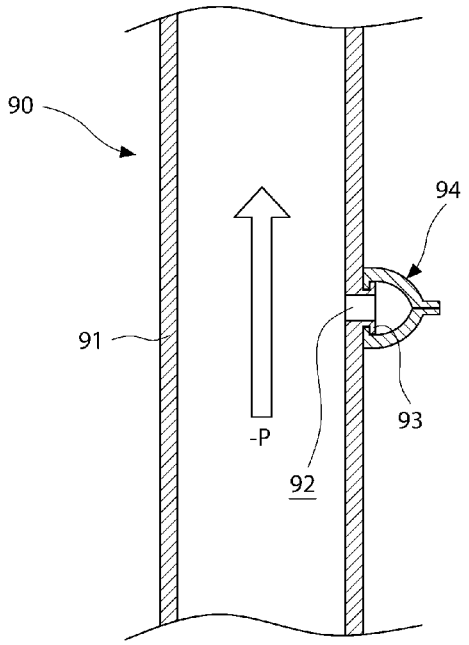
FIGS. 26 and 27 are views showing the operation of an opening/closing member according to an eighth embodiment of the present invention.
Figure 27:
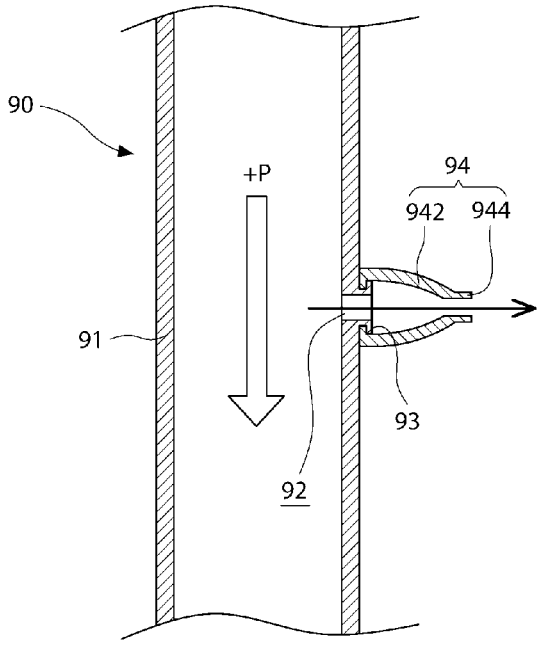

FIGS. 26 and 27 are views showing the operation of an opening/closing member according to the eighth embodiment.

Referring to FIGS. 26 and 27, an opening/closing member 90 according to the seventh embodiment may include a connection pipe 91 connected to the water supply channel 30 to form a passage for water or air, an opening 92 formed through the connection pipe 91, and an opening/closing means 94 that opens/closes the opening 82.

In detail, the upper and lower ends of the connection pipe 91 are connected to the water supply channel 30 to form a portion of the water supply channel 30. Further, the opening 92 communicates with the inside of the connection pipe 91.

A fixing portion 93 for fixing the opening/closing means 94 is formed around the opening 92. The fixing portion may be formed to fix the opening/closing means 94 by forcible-fitting, bonding, or combining to the end of the opening/closing means 94.

The opening/closing means 94 is fixed to the outer side of the pipe 91 to communicate with the opening 92. Further, the opening/closing means 94 may be made of rubber or silicon, which can be elastically deformed by pressure.

The opening/closing means 94 may be composed of an extender 942 that is fixed to the connection pipe 91 and extends in a cylinder shape and an opening/closing portion 944 that is opened/closed at the end of the extender 942. The opening/closing portion 944 is formed such that the vertical width decreases in a flat shape toward the front from the end of the extender 942. Further, the opening/closing 944 is formed such that the upper and lower portions come in surface contact.

The opening/closing member 90 having the configuration described above generates negative pressure in the water supply channel 30 for the water tank 27 at one side of the pump 41, when the pump 41 operates in the normal direction. Therefore, the opening/closing portion 944 of the opening/closing means 94 is kept closed, as shown in FIG. 14, water flows through the water supply channel 30.

Further, positive pressure is generated in the water supply channel for the water tank 27 at one side of the pump 41, when the pump 41 operates in the reverse direction. Therefore, water can flow into the opening/closing means 94 through the opening 92, as shown in FIG. 15.

As water flows into the opening/closing means 94, pressure is generated to the opening/closing portion 944 due to the structural feature of the opening/closing means 94 that gradually decreases in vertical width. Therefore, the opening/closing portion 944 can be opened while elastically deforming by means of pressure. As the opening/closing portion 944 opens, the water and air in the water supply channel 30 is discharged outside the opening/closing member 90 and can flow into the water tank 27.

On the other hand, the refrigerator according to the present invention may be implemented by various embodiments, other than the embodiments described above. A ninth embodiment of the present invention is described hereafter.

The ninth embodiment has the same configurations as the fifth embodiment, except for the structure of the opening/closing member, such that the same configurations are given the same reference numerals and the detailed description is not provided.

Figure 28:
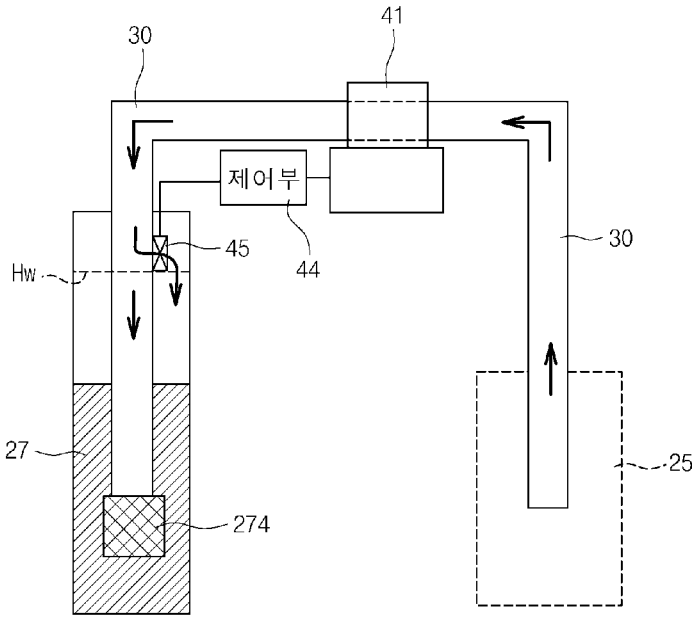
FIG. 28 is a perspective view schematically showing the flow of water between the water tank and the dispenser according to the ninth embodiment of the present invention.

FIG. 28 is a perspective view schematically showing the flow of water between the water tank and the dispenser according to the ninth embodiment.

Referring to FIG. 28, an opening/closing member 45 according to the ninth embodiment is disposed in the water supply channel 30 for the water tank 27. The opening/closing member 45 can be opened when the pump 41 operates in the reverse direction and may be an electronic valve that is controlled by a controller 44.

In detail, the opening/closing member 45 is a common electronic on/off valve and may be disposed in the water tank 27 above the highest water level H2 of the water tank 27. Therefore, at least some of the water and air flowing to the water tank 27 through the water supply channel 30 when the opening/closing member 45 is open can be directly discharged into the water tank 27 through the opening/closing member 45.

The opening/closing member 45 is electrically connected with the controller 44 controlling the pump 41. Further, when the pump 41 operates in the normal direction, the controller 44 keeps the opening/closing member 45 closed such that the water in the water tank 27 can be supplied to the dispenser 25 through the water supply channel 30.

On the contrary, when the pump 41 operates in the reverse direction, the controller 44 can open the opening/closing member 45 by send a signal for opening the opening/closing member 45. Therefore, the water and air remaining in the water supply channel 30 for the dispenser 25 at one side of the pump 41 are sucked, such that they can be discharged to the water tank 27 through the opening/closing member 45.

INDUSTRIAL APPLICABILITY

According to the embodiments, water supply defects between the ice maker and the dispenser can be removed, such that the water supply performance can be improved. Load in the pump can be reduced, such that the performance and durability of the pump can be improved. Since it is possible to prevent water from remaining when finishing taking out water from the dispenser, the industrial applicability is very high.

The invention claimed is:

1. A refrigerator comprising:

a cabinet having a storage compartment;

a door for opening or closing the storage compartment;

a water tank provided in the door and configured to store water to supply to an ice maker and/or a dispenser;

a tank connector to mount the water tank on a rear part of door;

a water supply channel that extends to supply the water in the water tank to the ice maker and the dispenser;

a pump disposed in the water supply channel to pump up the water in the water tank;

a valve disposed in the water supply channel so that the water discharged from the pump can be selectively supplied to the ice maker or the dispenser; and an air exhaust unit disposed in a position of the water supply channel which connects an outlet of the pump and an inlet of the valve, the air exhaust unit including:

an input portion connected to the water supply channel at the outlet of the pump;

an output portion connected to the water supply channel at inlet of the valve;

an air exhaust portion formed at a position between the input portion and the output portion for discharging air in the air exhaust unit and extending upwardly; and an opening/closing member formed in a ball shape and disposed in the air exhaust portion, wherein the air exhaust portion includes:

a support portion formed at a bottom thereof to support the opening/closing member and having one or more air holes offset from the center of the support portion to discharge the air in the air exhaust unit;

a space formed thereinside and having a diameter bigger than a diameter of the opening/closing member to movably accommodate the opening/closing member; and an air outlet formed at an end portion thereof and having a diameter smaller than the diameter of the opening/closing member, wherein, when the air is contained in the air exhaust unit, the one or more air holes discharge the air into the air exhaust portion to keep the opening/closing member on the support portion without moving such that the air outlet becomes open, and wherein, when the air is not contained in the air exhaust unit, the one or more air holes discharge the water into the air exhaust portion to keep the opening/closing member lifted by the water flowing in the air exhaust portion to close the air outlet.

2. The refrigerator of claim 1, wherein the air exhaust portion further includes one or more additional spaces formed between an upper end of the space and the air outlet, and wherein a diameter of the additional space is smaller than the diameter of the space.

3. The refrigerator of claim 1, wherein the pump and the valve is formed in one body by a mounting member.

4. The refrigerator of claim 1, wherein a line connecting centers of the input and output portions of the air exhaust unit extends laterally.

5. The refrigerator of claim 1, wherein the water tank is detachable from the tank connector.

6. The refrigerator of claim 5, wherein the water tank is detachably mounted on the door by the tank connector.

7. The refrigerator of claim 1, wherein the pump, the valve and the air exhaust unit is disposed in a machine room.

* * * * *